US009169576B2

(12) United States Patent
Saito et al.

(10) Patent No.: US 9,169,576 B2
(45) Date of Patent: Oct. 27, 2015

(54) ELECTROLYTIC COPPER PLATING SOLUTION AND METHOD OF ELECTROLYTIC COPPER PLATING

(71) Applicant: Rohm and Haas Electronic Materials LLC, Marlborough, MA (US)

(72) Inventors: Mutsuko Saito, Niigata (JP); Makoto Sakai, Niigata (JP); Yoko Mizuno, Niigata (JP); Toshiyuki Morinaga, Niigata (JP); Shinjiro Hayashi, Niigata (JP)

(73) Assignee: Rohm and Haas Electronic Materials LLC

( * ) Notice: Subject to any disclaimer, the term of this patent is extended or adjusted under 35 U.S.C. 154(b) by 201 days.

(21) Appl. No.: 13/907,433

(22) Filed: May 31, 2013

(65) Prior Publication Data

US 2013/0319867 A1 Dec. 5, 2013

(30) Foreign Application Priority Data

May 31, 2012 (JP) ..... 2012-125008

(51) Int. Cl.

| | |
|---|---|
| ***C25D 3/38*** | (2006.01) |
| ***C25D 3/40*** | (2006.01) |
| ***C23C 18/40*** | (2006.01) |
| ***C25D 5/02*** | (2006.01) |

(52) U.S. Cl.

CPC ... *C25D 3/38* (2013.01); *C25D 5/02* (2013.01)

(58) Field of Classification Search

CPC ..... C25D 3/38; C25D 7/12; C25D 3/40; C25C 1/12; C23C 18/40

USPC ..... 205/298, 291, 293, 296, 297; 106/1.26

See application file for complete search history.

(56) References Cited

U.S. PATENT DOCUMENTS

| | | | | |
|---|---|---|---|---|
| 4,683,036 | A * | 7/1987 | Morrissey et al. | 205/125 |
| 6,881,319 | B2 * | 4/2005 | Seita et al. | 205/296 |
| 8,262,894 | B2 * | 9/2012 | Xu et al. | 205/291 |
| 8,268,157 | B2 | 9/2012 | Niazimbetova | |
| 2004/0089557 | A1 | 5/2004 | Tsuchida et al. | |
| 2009/0000953 | A1 | 1/2009 | Orihashi et al. | |

FOREIGN PATENT DOCUMENTS

| | | | | |
|---|---|---|---|---|
| WO | WO2009135572 | * | 3/2009 | |
| WO | WO 2009135572 A2 | * | 11/2009 | C25D 3/58 |

OTHER PUBLICATIONS

Taiwan Search Report of corresponding Taiwan Application No. 102119309.

* cited by examiner

*Primary Examiner* — Edna Wong

(57) ABSTRACT

An electrolytic copper plating solution is provided which has an excellent via filling ability without using formaldehyde, which is harmful to the environment. An electrolytic copper plating solution which contains compounds which have an —X—S—Y— structure wherein X and Y are individually atoms selected from a group comprising hydrogen, carbon, sulfur, nitrogen, and oxygen atoms and X and Y can be the same only when they are carbon atoms and specific nitrogen-containing compounds. Good filled vias can be made without causing a worsening of the exterior appearance of the plating by using this electrolytic copper plating solution.

6 Claims, 5 Drawing Sheets

ELECTROLYTIC COPPER PLATING SOLUTION AND METHOD OF ELECTROLYTIC COPPER PLATING

FIELD OF THE INVENTION

This invention concerns an electrolytic copper plating solution which contains a compound containing a sulfur atom and a specific nitrogen-containing compound, as well as a method of electrolytic copper plating which uses this electrolytic copper plating solution.

BACKGROUND OF THE INVENTION

In recent years, a plating method known as "through-hole plating" or "via filling plating" has been used in basic production of printed circuit boards used in electronic devices such as personal computers. Electrolytic copper plating is expected to have application to through-hole and via plating, since the rate of deposition of the plating film is rapid, 10-50 μm/hr. However, if the copper is deposited on the whole inner via surfaces, the rate of deposition near the bottom of the vias must be more rapid than the rate of deposition in their opening parts in order for the inside of the vias to be filled with copper without leaving voids. If the rate of deposition near the bottoms is the same as or slower than the rate of deposition in the opening parts, either the vias will not be filled, or the opening parts will plug up before the copper plating filling inside the vias is completed, voids will be left inside them, and in either case they will not be suitable for use. Moreover, in through-hole plating, there is a requirement that the covering ability of the plating in the through holes, known as "throwing power," be good.

Up to now, electrolytic copper plating baths containing specific compounds which contain sulfur atoms have been used to accelerate the deposition rates near the bottoms of vias and on the walls of through-holes; as for the electrolysis conditions, direct-current electrolysis using soluble anodes, such as phosphorus-containing copper anodes, has generally been used. With this method, however, although there is a good via filling performance immediately after the bath is made, the electrolytic copper plating bath becomes unstable over time and problems are produced after a certain period of time has elapsed after the formation of the bath, including the facts that particle lumps are produced in the formation of the electrolytic copper plating layer, the external appearance of the plating becomes worse, the filling of the via becomes unstable, etc. Furthermore, the reliability of the resistance to thermal shock and the throwing power are reduced in through-hole plating.

In order to solve these problems, an electrolytic copper plating solution which contains specific compounds containing sulfur atoms and thiol reactive compounds is disclosed in Japanese Unexamined Patent Application No. 2002-249891. As the thiol reactive compounds, aliphatic and alicyclic compounds, carboxylic acids, peroxo acids of aromatic or heterocyclic compounds, aldehydes and ketones, and hydrogen peroxide are disclosed, and it is stated in the working examples that formaldehyde improves the filling ability. In recent years, however, considering the effects of formaldehyde on the environment and the human body, the fact that its flash point is low (66° C.), etc., efforts have been made to find outer compounds with via filling ability improving performances to substitute for formaldehyde. Moreover, although an electrolytic copper plating solution is disclosed in Japanese Unexamined Patent Application No. 2011-207878 which contains accelerants (glossifying agents) containing sulfur atoms and reaction products of nitrogen-containing compounds and epoxide compounds, there is no mention in this reference to the problem of degradation products due to changes over time in the accelerants containing sulfur atoms.

SUMMARY OF THE INVENTION

This invention was made with the situation described above in mind. Its purpose is to provide an electrolytic copper plating solution containing specific compounds which contain sulfur atoms which is suitable for forming filled vias without using formaldehyde and without degrading the external appearance of the plating, as well as providing a method of electrolytic copper plating using this electrolytic copper plating solution.

The inventors diligently investigated many kinds of compounds, and as a result discovered that the problems mentioned above could be solved by using specific nitrogen-containing compounds in place of formaldehyde. Thus, they perfected this invention.

That is, this invention concerns an electrolytic copper plating solution which contains compounds with an —X—S—Y— structure wherein X and Y are individually atoms selected from a group comprising hydrogen, carbon, sulfur, nitrogen, and oxygen atoms and X and Y can be the same only when they are carbon atoms, as well as compounds shown by general formula (1);

(1)

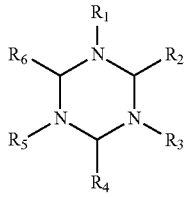

wherein $R_1$ to $R_6$ are, independent of each other, alkyl groups with carbon numbers of 1 to 4 which are optionally substituted with hydrogen atoms or functional groups; at least 2 of $R_1$ to $R_6$ may be linked to each other to form rings; and $R_1$ to $R_6$ may contain hetero atoms. Moreover, it also concerns a method of electrolytic copper plating which uses the aforementioned electrolytic copper plating solution.

As explained below, it is possible, by means of this invention, to reduce the effects of compounds with an —X—$S^-$ structure, which are degradation products of the sulfur-containing compounds, and thus improve the via filling ability without degrading the external appearance of the plating by using an electrolytic copper plating solution containing sulfur-containing compounds and compounds shown by general formula (1).

DETAILED DESCRIPTION OF THE INVENTION

Figure 1:
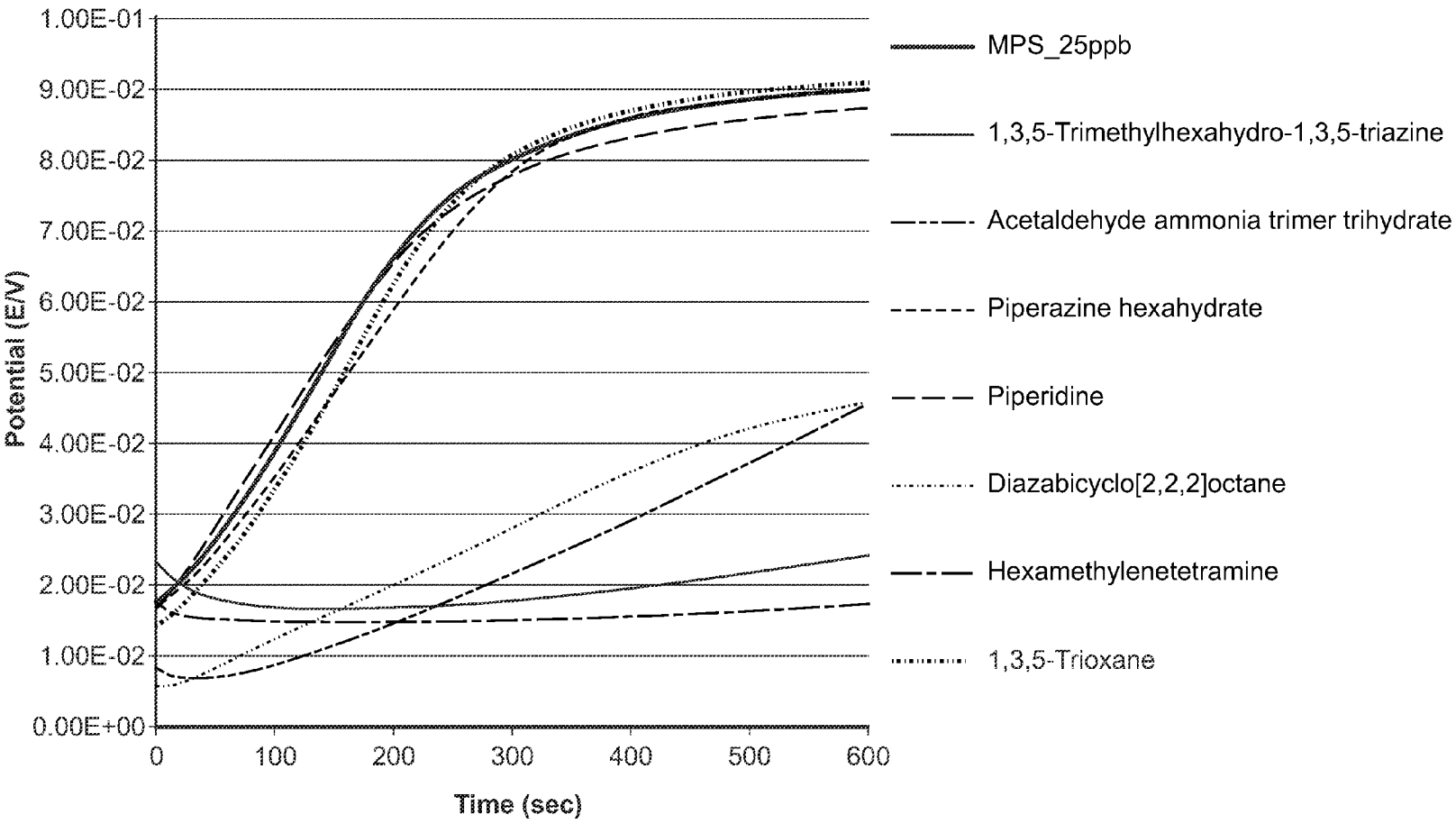
FIG. 1 is a graph which shows the results of electrochemical measurements.

In the electrolytic copper plating solution of this invention, any bath solution may be used as long as it is one which can electroplate copper. For example, one can use copper sulfate, copper cyanide, copper pyrophosphate, etc., plating solutions, but usable solutions are not limited to these. Preferably, the electrolytic copper plating solution is a copper sulfate plating solution. As a representative example of the electrolytic copper plating solutions, the explanation will concern copper sulfate plating solutions, but persons skilled in the art can easily determine the compositions, ingredients, etc., of other plating solutions from the following descriptions of copper sulfate plating solutions in these specifications and the public references, etc.

The electrolytic copper plating solution of this invention contains compounds with a —X—S—Y— structure. Preferably, the X and Y in the structure of these compounds are individually atoms selected from a group comprising hydrogen, carbon, nitrogen, sulfur, and oxygen atoms; in these specifications, for convenience, these compounds will be called "sulfur-containing compounds." More desirably, X and Y are individually atoms selected from a group comprising hydrogen, carbon, nitrogen, and sulfur atoms, and still more desirably, X and Y are individually atoms selected from a group comprising hydrogen, carbon, and sulfur atoms. However, X and Y can be the same only if they are carbon atoms. Furthermore, in the structural formula —X—S—Y—, S is shown with a valence of 2, but this does not mean that this is a valence of only the X and Y atoms; it means that the X and Y atoms can be linked to any other arbitrary atoms corresponding to this valence. For example, if X is a hydrogen, it has the structure H—S—Y—.

Preferably, the sulfur-containing compounds are compounds which have groups which are sulfonate groups or alkali metal salts of sulfonic acid in their molecules. There may be one or more sulfonic acid group or its alkali metal salts in these molecules. More desirably, the sulfur-containing compounds are compounds with $S—CH_2O—R—SO_3M$ structures, or compounds with $—S—R—SO_3M$ structures in their molecules wherein M is a hydrogen or alkali metal atom and R is an alkyl group with a carbon number of 3-8. Still more desirably, the sulfur-containing compounds are compounds with the following structures (S1)-(S8):

$$M\text{-}SO_3—(CH_2)_a—S—(CH_2)_b—SO_3\text{-}M; \quad (S1)$$

$$M\text{-}SO_3—(CH_2)_a—O—CH_2—S—CH_2—O—(CH_2)_b—SO_3\text{-}M; \quad (S2)$$

$$M\text{-}SO_3—(CH_2)_a—S—S—(CH_2)_b—SO_3\text{-}M; \quad (S3)$$

$$M\text{-}SO_3—(CH_2)_a—O—CH_2—S—S—CH_2—O—(CH_2)_b—SO_3\text{-}M; \quad (S4)$$

$$M\text{-}SO_3—(CH_2)_a—S—C(=S)—S—(CH_2)_b—SO_3\text{-}M; \quad (S5)$$

$$M\text{-}SO_3—(CH_2)_a—O—CH_2—S—C(=S)—S—CH_2—O—(CH_2)_b—SO_3\text{-}M; \quad (S6)$$

$$A\text{-}S—(CH_2)_a—SO_3\text{-}M; \text{ or} \quad (S7)$$

$$A\text{-}S—CH_2—O—(CH_2)_a—SO_3\text{-}M \quad (S8)$$

In the formulas (S1)-(S8), a and b are individually integers in the range of 3-8; M is a hydrogen or an alkali metal element and A is a hydrogen atom, alkyl group with a carbon number of 1-10, aryl group, a chain or cyclic amine compound constituted by 1-6 nitrogen atoms, 1-20 carbon atoms, and a plurality of hydrogen atoms, or a heterocyclic compound constituted by 1-2 sulfur atoms, 1-6 nitrogen atoms, and 1-20 carbon atoms.

Sulfur-containing compounds are generally used as glossifying agents also known as "brighteners", but they are also included in the scope of this invention if they are used for other purposes. If sulfur-containing compounds are used, one may use only 1 kind or a mixture of 2 or more kinds.

If the sulfur-containing compounds are glossifying agents, these agents can be used in a range of, for example, 0.1-100 mg/L, preferably 0.5-10 mg/L. If their concentration in the plating solution is less than 0.1 mg/L, the effect of aiding the growth of the copper plating film may not be obtained. In addition, even if their concentration exceeds 100 mg/L, there will be almost no effectiveness commensurate with this excess; therefore, this will not be desirable from an economic point of view. If the sulfur-containing compounds are used for purposes other than glossifying agents, suitable ranges for the quantities of them that are used can be determined as is suitable by persons skilled in the art.

The inventors discovered that increases in the —X—S— or —Y—S— compounds which are degradation products produced by the severing of the —X—S—Y— single bonds of these sulfur-containing compounds worsen the filling performance of the vias and the external appearance of the plating. Here, the X and Y can be exchanged in the aforementioned sulfur-containing compounds; for example, in the case of the aforementioned glossifying agent (S1) $M\text{-}SO_3—(CH_2)_a—S—(CH_2)_b—SO_3\text{-}M$, it is believed that $M\text{-}SO_3—(CH_2)_a—S^-$ or $^-S—(CH_2)_b—SO_3\text{-}M$ are produced as degradation products, but either of them may be written as $—X—S^-$ or $—Y—S^-$. Therefore, for convenience, the degradation products of the sulfur-containing compounds will be written as "$—X—S^-$" in these Specifications.

Although it is not restricted by theory, the principal mechanism by which compounds with the $—X—S^-$ structure are produced in the copper electrolytic copper plating solution is thought to be, for example, that, as a result of using soluble anodes such as phosphorus-containing copper, compounds with the $—X—S^-$ structure are produced by a reaction of the soluble anode and the aforementioned sulfur-containing compounds during periods when the electrolysis is stopped and the S—X or S—Y single bonds being severed. Moreover, it is believed that, in the copper electroplating process, the aforementioned sulfur-containing compounds accept electrons at the cathode and the S—X or S—Y single bonds are severed, producing compounds with the $—X—S^-$ structure. At the anode, it is thought, electrons which are emitted from the soluble anode when the Cu becomes $Cu^{2+}$ are accepted and the aforementioned sulfur-containing compounds take on the $—X—S^-$ structure.

Moreover, although it is not restricted by theory, the mechanism of the activity by which the compounds with the $—X—S^-$ structure have bad effects in copper electroplating is thought to be that these compounds bond ionically with metal ions, for example, $Cu^+$ and $Cu^{2+}$ and the precipitated metals form metal layers with inferior adhesiveness, heat resistance, etc., by forming particle lumps, and also degrade the external appearance of the plating, by producing bad glosses, etc. Moreover, in the formation of filled vias, also, bound substances of the aforementioned degradation products and metal ions are thought to make the rate of deposition of the metal near the bottoms of the vias about equal to or less than the rate of deposition of the metal at the via openings, and thus cause the problems of making the filling of the vias insufficient, or filling the vias with voids left in them, depending on the shapes of the vias.

The concentrations of the compounds with the —X—S⁻ structure can be greatly reduced by performing the copper electroplating by using the plating solution of this invention. From the point of view of not making the gloss of the external appearance of the plating matte, it is desirable for the concentrations of the compounds with the —X—S⁻ structure to be kept at 2.0 μmol/L or lower. From the point of view of making the external appearance of the plating gloss, it is desirable to keep the concentrations at 1.0 μmol/L or lower, and preferably 0.5 μmol/L or lower. Moreover, from the point of view of obtaining a good via filling ability, it is desirable for the concentrations of the compounds with the —X—S⁻ structure to be kept at 0.15 μmol/L or lower, and preferably 1.0 μmol/L or lower.

The copper electroplating solution of this invention contains compounds shown by general formula (1):

(1)

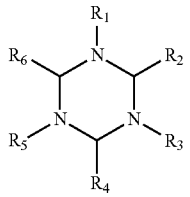

Here, $R_1$ to $R_6$ are, independent of each other, alkyl groups with carbon numbers of 1 to 4 which are optionally substituted with hydrogen atoms or functional groups. The alkyl groups are linear or branched alkyl groups, for example, methyl, ethyl, normal propyl, isopropyl, normal butyl, tertiary butyl, and isobutyl groups. The substituents of the alkyl groups may be, for example, hydroxyl, carboxyl, amino, nitro, etc., groups. At least two of $R_1$ to $R_6$ may link together to form rings. Moreover, $R_1$ to $R_6$ may contain hetero atoms. One or two or more of these may be used in the plating solution.

The compounds shown by general formula (1) above are desirably compounds shown by general formula (2) or general formula (3);

General formula (2)

(2)

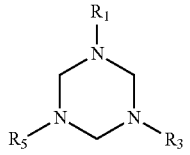

General formula (3)

(3)

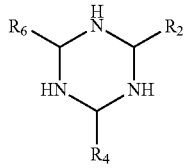

In general formula (2), $R_1$, $R_3$, and $R_5$ are, independently of each other, hydrogen atoms or alkyl groups with carbon numbers of 1 to 4, optionally substituted with hydroxyl groups. The alkyl groups are linear or branched alkyl groups, for example, methyl, ethyl, normal propyl, isopropyl, normal butyl, tertiary butyl, and isobutyl groups. At least two of $R_1$, $R_3$, and $R_5$ may link to each other and form rings. Moreover, $R_1$, $R_3$, and $R_5$ may contain hetero atoms.

In general formula (3), $R_2$, $R_4$, and $R_6$ are, independent of each other, hydrogen atoms or alkyl groups with carbon numbers of 1 to 4. The alkyl groups are linear or branched alkyl groups, for example, methyl, ethyl, normal propyl, isopropyl, normal butyl, tertiary butyl, and isobutyl groups.

The compounds shown by general formula (2) include, for example, the following:

(2-1)

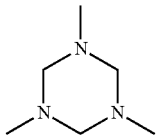

(2-2)

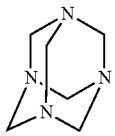

(2-3)

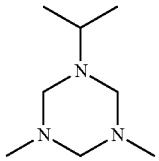

(2-4)

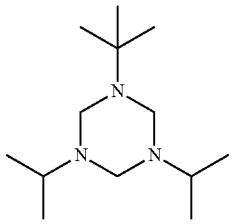

(2-5)

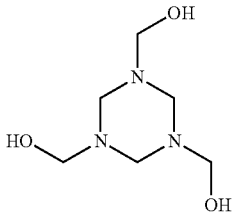

(2-6)

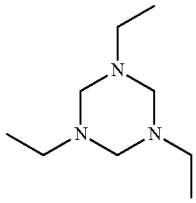

And the compounds shown by general formula (3) include, for example, the following:

(3-1)

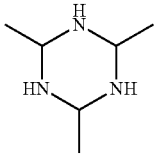

(3-2)

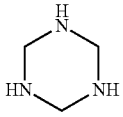

(3-3)

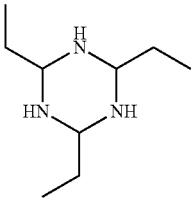

The quantities of the compounds shown by general formula (1) added to the copper electroplating solution in this invention can be decided on as is suitable, according to the purposes of improving the external appearance of the plating and improving the via filling ability, and the quantities of sulfur-containing compounds added to the copper electroplating solution can be decided on as is suitable, according to the conditions of the copper electroplating process, for example, the kinds of electrodes used, the method of loading the current, etc. It is desirable for the copper electroplating solution to contain the compounds shown by general formula (1) at concentrations of 1-100,000 mg/L, preferably 5-1000 mg/L.

In this invention, the compounds shown by general formula (1) can be added to the copper electroplating solution at any arbitrary point in time. For example, they may be added when the copper electroplating bath is made, during the copper electroplating process, or after the copper electroplating process. The compounds shown by general formula (1) may be added while monitoring the compounds in the plating solution with the —X—S⁻ structure when these compounds exceed a specific quantity, using the fact that the desired plating performance is not longer obtained as an index. Moreover, the compounds shown by general formula (1) may be added as is, or dissolved in water, or mixed with other additives.

Except for the compounds with the —X—S—Y— structure and the compounds shown by general formula (1), the basic composition of the copper electroplating solution of this invention is not particularly limited, as long as it is one which is used in ordinary copper electroplating. The components of the basic composition may be changed, their concentrations may be changed, additives may be added, etc., as is suitable, as long as the purposes of the invention are achieved. For example, in the case of copper sulfate plating, the copper sulfate plating solution may be an aqueous solution which contains sulfuric acid, copper sulfate, and water-soluble chlorine compounds, and others may be used without any particular limitations, as long as they are used in publicly known copper sulfate plating.

The sulfuric acid concentration in the copper sulfate plating solution is ordinarily 10-400 g/L in plating baths for use with general through-holes, and preferably 150-250 g/L. Moreover, in general via plating baths, it is ordinarily 10-400 g/L, preferably 50-100 g/L. For example, if the sulfuric acid concentration is less than 10 g/L, the conductivity of the plating bath will be lowered, so that in some cases it will become difficult to conduct electricity through the plating solution. Moreover, if it is higher than 400 g/L, dissolution of the copper sulfate in the bath will be hindered and precipitation of copper sulfate will be caused in some cases. The copper sulfate concentration in the copper sulfate plating bath is ordinarily 20-280 g/L in plating baths for general through-hole plating, and preferably 50-100 g/L. Moreover, it is ordinarily 20-280 g/L, preferably 100-250 g/L, in general baths for via plating. For example, if the copper sulfate concentration is less than 20 g/L, the supply of copper ions to the substrate which is to be plated will be insufficient and it will be difficult to precipitate a normal plating film in some cases. Moreover, in general, it will be difficult to dissolve the copper sulfate if its concentration exceeds 280 g.

The water-soluble chlorine compounds contained in the copper sulfate plating solution are not particularly limited; they may be ones which are used in publicly known copper sulfate plating. Examples of these water-soluble chlorine compounds are hydrochloric acid, sodium chloride, potassium chloride, ammonium chloride, etc., but they are not limited to these examples. One may use only one water-soluble chlorine compound or a mixture of 2 or more. The concentration of the water-soluble chlorine compounds contained in the copper sulfate plating solution used in this invention is ordinarily in the range of 10-200 mg/L, preferably 30-80 mg/L, as the chlorine ion concentration. For example, if the chlorine ion concentration is less than 10 mg/L, the glossifying agents, surfactants, etc., may sometimes become difficult to use normally. Moreover, if it exceeds 200 mg/L, the production of chlorine gas from the anode becomes great.

The electrolytic copper plating solution used in this invention may also contain levelers also known as "leveling agents". "Levelers" is a general term for compounds which are selectively adsorbed on the plated surface when plating is performed and control the deposition speed. The levelers may be any publicly known surfactants which are ordinarily used as additives to electrolytic copper plating solutions. When surfactants are used as levelers, compounds which have the structures (A1)-(A5) below are preferably used, but they are not limited to these examples.

(A1) $HO—(CH_2—CH_2—O)_a—H$ where a is an integer in the range of 5-500

(A2) $HO—(CH_2—CH(CH_3)—O)_a—H$ where a is an integer in the range of 5-200

(A3) $HO—(CH_2—CH_2—O)_a—(CH_2—CH(CH_3)—O)_a—(CH_2—CH_2—O)_c—H$ where a and c are integers, a+c is an integer in the range of 5-250, and b is an integer in the range of 1-100

(A4) $H—(NH_2CHCH_2)_n—H$ where n is in the range of 5-500 or (A5)

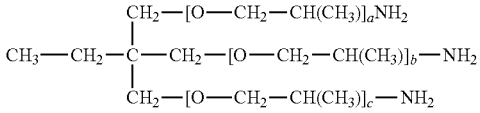

where a, b, and c are each integers in the range of 5-200

Furthermore, nitrogen-containing organic compounds which are different from the nitrogen compounds shown in general formula (1), for example, reaction products of imidazoles and epoxy compounds, such as those mentioned in Patent Reference 2, nitrogen-containing surfactants such as (A4) and (A5) above, nitrogen-containing organic compounds such as polyacrylic acid amides, etc., may also be used.

One may use only one of the levelers used in this invention or a mixture of 2 or more. The levelers can be used in a range of, for example, 0.05-10 g/L, preferably 0.1-5 g/L. If the concentration in the plating solution is less than 0.05 g/L, the wetting effect will be insufficient, and therefore many pinholes may be produced in the plating film and the deposition of a normal plating film will become difficult. Moreover, even if the concentration is more than 10 g/L, hardly any increase in the effect which corresponds to this excess will be obtained; therefore, this is undesirable from an economic point of view.

The electrolytic copper plating solution used in this invention may also contain carriers. Ordinarily, surfactants are used as carriers; they are adsorbed uniformly on the whole plated surface during plating and have the effect of controlling the deposition speed.

Specific examples of them are polyethylene glycol (PEG), polyoxypropylene glycol, block or random copolymers of polyethylene glycol and polypropylene glycol, etc., but they are not limited to these examples.

The carriers used in this invention may be only one or a mixture of 2 or more. The carriers can be used in a range of, for example, 0.005-10 g/L, preferably 0.05-2 g/L.

The substrates on which the method of electrolytic copper plating of this invention can be used are ones which can withstand the conditions of the method of electrolytic copper plating; one can use substrates of any desired materials and forms as long as metal films are formed by plating. Examples of the materials are resins, ceramics, metals, etc., but they are not limited to these examples. Examples of substrates consisting of resins are printed circuit boards, and examples of substrates consisting of ceramics are semiconductor wafers, but they are not limited to these examples. Moreover, an example of a metal is silicon; an example of a substrate consisting of a metal is a silicon wafer, but they are not limited to this example. Since the method of electrolytic copper plating of this invention is especially good for filling via holes, substrates which have through-holes via holes, etc., are desirable as the substrates for this invention, and printed circuit boards or wafers with through-holes and/or via holes are more desirable.

Examples of resins which are used in the substrates are thermoplastic resins and thermosetting resins. Examples of thermoplastic resins are polyethylene resins, such as high-density polyethylene, medium-density polyethylene, branched low-density polyethylene, linear low-density polyethylene, and ultrahigh-molecular-weight polyethylene; polyolefin resins, such as polypropylene resin, polybutadiene, polybutene resin, polybutylene resin, and polystyrene resin; halogen-containing resins, such as polyvinyl chloride resin, polyvinylidene chloride resin, polyvinylidene chloride-vinyl chloride copolymer resin, chlorinated polyethylene, chlorinated polypropylene, tetrafluoroethylene, etc.; AS resins; ABS resins; MBS resins; polyvinyl alcohol resins; polyacrylate resins, such as poly(methyl acrylate); polymethacrylate resins, such as poly(methyl methacrylate); methyl methacrylate-styrene copolymer resins; maleic anhydride-styrene copolymer resins; polyvinyl acetate resins; cellulosic resins, such as cellulose propionate resins, cellulose acetate resins, etc.; epoxy resins; polyimide resins; polyamide resins, such as nylon; polyamide imide resins; polyacrylate resins; polyether imide resins; polyetheretherketone resins; polyethylene oxide resins; various polyester resins, such as PET resins; polycarbonate resins; polysulfone resins; polyvinyl ether resins; polyvinyl butyral resins; polyphenylene ether resins, such as polyphenylene oxide; polyphenylene sulfide resins; polybutylene terephthalate resins; polymethyl pentene resins; polyacetal resins; vinyl chloride-vinyl acetate copolymers; ethylene-vinyl acetate copolymers; and ethylene-vinyl chloride copolymers; and copolymers, blends, etc., of these. Examples of thermosetting resins are epoxy resins; xylene resins, guanamine resins; diallyl phthalate resins; vinyl ester resins; phenol resins; unsaturated polyester resins; furan resins; polyimide resins; polyurethane resins; maleic acid resins; melamine resins; and urea resins. Mixtures of these resins may also be used. However, the resins which can be used are not limited to these. Desirable resins are epoxy resins, polyimide resins, vinyl resins, phenol resins, nylon resins, polyphenylene ether resins, polypropylene resins, fluorine resins, and ABS resins. Preferable ones are epoxy resins, polyimide resins, polyphenylene ether resins, fluorine resins, and ABS resins, and still more desirable ones are epoxy resins and polyimide resins. Moreover, the resin substrates may consist of single resins or multiple resins. Furthermore, they may be composites in which resins are applied to other substrates or laminated with them. The resin substrates which can be used in this invention are not limited to resin moldings; they may also be composites in which reinforcing materials such as glass-fiber-reinforcing materials are interposed between resins, or ones in which films consisting of resins are formed on substrates which are composed of various materials such as ceramics, glass, or metals such as silicon.

Examples of ceramics which can be used as substrate materials are alumina ($Al_2O_3$), steatite ($MgO.SiO_2$), forsterite ($2MgO.SiO_2$), mullite ($3Al_22O_3.2SiO_2$), magnesia (MgO), spinel ($MgO.Al_2O_3$), beryllia (BeO), and other oxide ceramics; non-oxide ceramics, such as aluminum nitride, silicon carbide, etc.; and low-temperature-firing ceramics, such as glass ceramics. However, they are not limited to these.

Before the copper electroplating is performed, the parts of the substrates on which the method of electrolytic copper plating of this invention can be used which will be plated are treated to make them conductive. For example, when vias will be filled with metallic copper by copper electroplating using the method of this invention, the inner surfaces of the vias are first conductivized. This treatment may be performed by using any publicly known conductivizing treatment, for example, electroless copper plating, direct plating, adsorption of conductive microparticles, vapor-phase plating, etc., but it is not limited to these.

In the copper electroplating method of this invention, the plating temperature (solution temperature) may be set at a temperature which is suitable for the kind of plating bath; ordinarily, it is in the range of 10-40° C., preferably 20-30° C. If the plating temperature is lower than 10° C., the conductivity of the plating solution will be lowered; therefore, the current density during the electrolysis cannot be made high, the rate of growth of the plating film will be slow, and productivity may be lowered. Moreover, if the plating temperature is higher than 40° C., the glossifying agent may decompose. Any desired kind of current may be used in the method of electrolytic copper plating of this invention, for example, direct current, pulse periodic reverse (PPR) current, etc. The current density of the anode which is employed may be set at one which is suitable for the kind of plating bath; ordinarily, it is in the range of 0.1-10 $A/dm^2$, preferably 1-3 $A/dm^2$. If it is less than 0.1 $A/dm^2$, the anode area will be too large, which is not economical, and if it is greater than 10 $A/dm^2$, the quantity of oxidation decomposition of the glossifying agent component will be increased by the production of oxygen in the electrolyte from the anode.

Any desired kinds of electrodes, such as soluble or insoluble anodes, may be used in the method of electrolytic copper plating of this invention. As a soluble anode, a phosphorus-containing copper anode may be used, and as insoluble anodes, iridium oxide, platinum-plated titanium, platinum, graphite, ferrite, titanium coated with lead dioxide or platinum group element oxides, stainless steel, etc., materials may be used, but they are not limited to these examples. In the plating method of this invention it is desirable to pass air or oxygen through the plating solution to raise the dissolved oxygen concentration in the solution. It is not restricted by theory, but the dissolved oxygen in the plating solution is thought to function as an oxidant, reducing the compounds with the X—S⁻ structure in the solution. As a method of raising the dissolved oxygen concentration in the plating solution, bubbling the solution with air or oxygen is desirable, and this bubbling may be performed in a way which agitates the solution, or it may be performed without relationship to agitation. Moreover, the bubbling which raises the dissolved oxygen concentration in the plating solution may be performed during the electroplating process or while the plating process is stopped. In the plating method of this invention, agitation may be performed; it is desirable to perform agitation in order to make the feeding of copper ions and additives to the surface to be plated uniform. Methods of agitation which can be used are air agitation and jets. From the point of view of increasing the dissolved oxygen in the plating solution, agitation by air is desirable. Moreover, even when agitation by jet is performed, it may be combined with agitation by air. Furthermore, moving the solution to another tank while filtering or circulation filtering may also be performed. It is especially desirable to filter the plating solution by circulation; by doing so, the temperature of the solution can be made uniform and foreign particles, precipitate, etc., can be removed from the solution.

A composite material with a copper layer on a substrate is obtained by the method of electrolytic copper plating of this invention. When copper electroplating is performed by using the electrolytic copper plating solution of this invention, the copper layer of the composite material that is obtained does not produce particle lumps, and when vias are filled, via filling can be accomplished without voids. This invention will be explained in detail below by working examples, but these examples do not limit the scope of the invention.

WORKING EXAMPLES

Analysis Methods

1. Galvanostatic Analysis

Galvanostatic analysis was performed to screen the performances of electrolytic copper plating solutions with various kinds of additives. Electrolytic copper plating solutions with the following composition were prepared and sodium mercapto-1-propanesulfonate (MPS/Tokyo Kasei Kogyo Co.) was added at 50 ppm to reproduce a simulated aged plating solution. An electrode (a platinum rotating disk electrode coated with copper/PIN Co.) was immersed in the simulated aged plating solution obtained, in a state in which no current was applied, and the potential on the copper (natural potential) was measured at 23° C. and 2500 rpm using a potentiostat/galvanostat electrochemical analysis system PGSTAT302/Eco Chem Co. FIG. 1 shows a typical example obtained by the measurement. In FIG. 1, the horizontal axis shows the time in seconds and the vertical axis the potential in volts (V). In the curves in FIG. 1, the upper curves show compositions with low efficacies, almost the same as the baseline composition (without addition); the lower the curve, the higher the efficacy obtained. The results obtained were classified in ranks A, B, and C, in the order of descending efficacy. Furthermore, rank A showed potentials of approximately less than 40% from the baseline after 90 seconds, rank B potentials of approximately 50% to 70%, and rank C potentials of approximately 90% or more.

Plating Solution Composition Before Addition of MPS

- Copper sulfate pentahydrate 200 g/L
- Sulfuric acid 100 g/L
- Chlorine 50 mg/L
- Brightener: bis(3-sulfopropyl)disulfide disodium (SPS) 2 mg/L
- Leveler: Nitrogen-containing surfactant 2 g/L
- Carrier: polyethylene glycol 1 g/L
- Various additives: quantities shown in Table 1
- Remainder: deionized water 2. Test Evaluating Via Filling Performance The via filling performances of the additives selected in this screening were evaluated. The unplated material (substrate) used was an evaluation board (CMK Co.) with via fills having an average diameter 100 μm and depth 60 μm (CMK Co.); for the plating solution, a simulated aged plating solution was used consisting of an electrolytic copper plating solution with the same composition as above to which MPS was added at 100 ppb. Via fill plating was performed by the following process. The vias were cut in vertical sections after the plating, perpendicular to the substrate surface, and the cut surfaces were observed with a metal microscope (GX51/Olympus Co.).

Plating Process

Electroless plating (CUPOSIT™ 253 available from Rohm and Haas Electronic Materials Co.);

- plating conditions: 35° C., 20 minutes
- Acid washing (ACID CLEANER™ 1022-B: 10% available from Rohm and Haas Electronic Materials Co.); 40° C./3 min water washing at 30-40°, 1 min.
- Water washing at room temperature, 1 min.
- Acid washing with 10% sulfuric acid, 1 min.
- Copper electroplating (various compositions, 22° C., current density: 2 A/dm$^2$, 45 min) water washing at room temperature, 1 min
- Rust inhibitor (ANTITARNISH™ 7130 available from Rohm and Haas Electronic Materials Co.) 10%, room temperature for 30 seconds
- Water washing at room temperature for 30 seconds
- Drying in dryer: 60° C. for 30 seconds

Working Examples 1-3 and Comparison Examples 1-5

Figure 2:
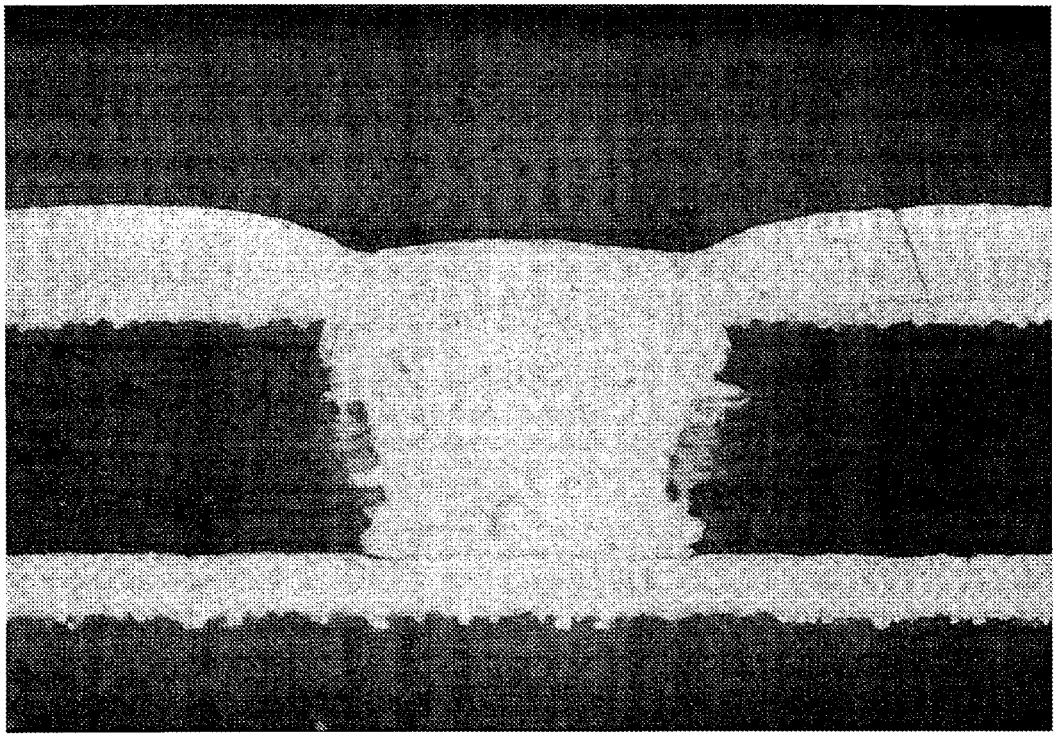
FIG. 2 is a drawing which shows the via filling ability when the plating solution of Working Example 1 is used; it shows the state of a cross section of a via after the plating process.
Figure 3:
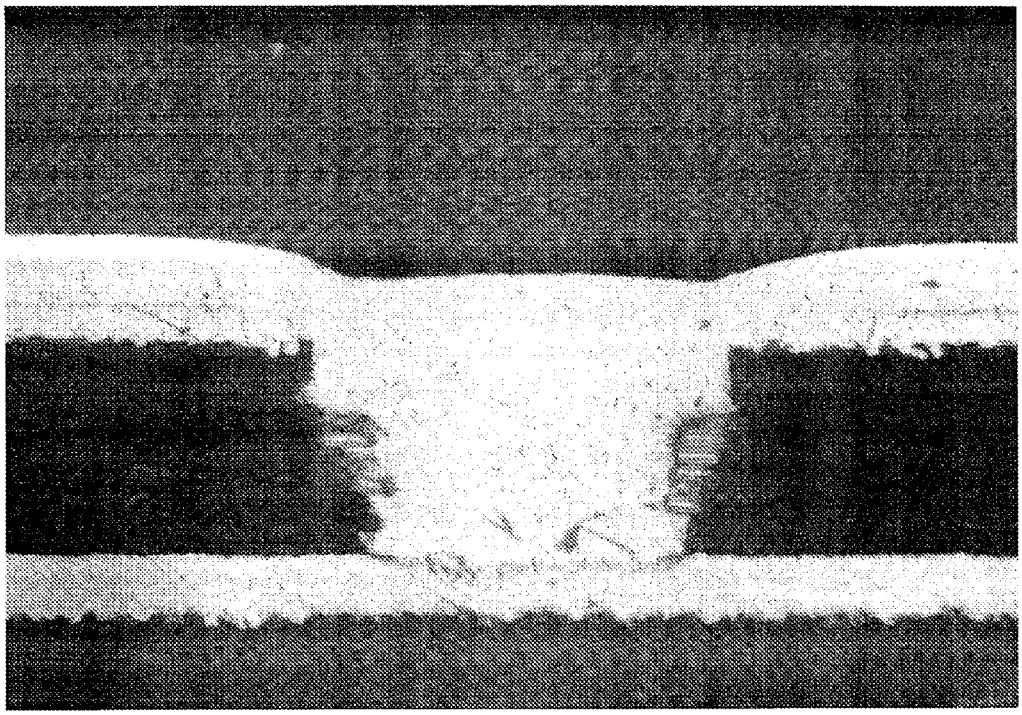
FIG. 3 is a drawing which shows the via filling ability when the plating solution of Working Example 2 is used; and it shows the state of a cross section of a via after the plating process.
Figure 4:
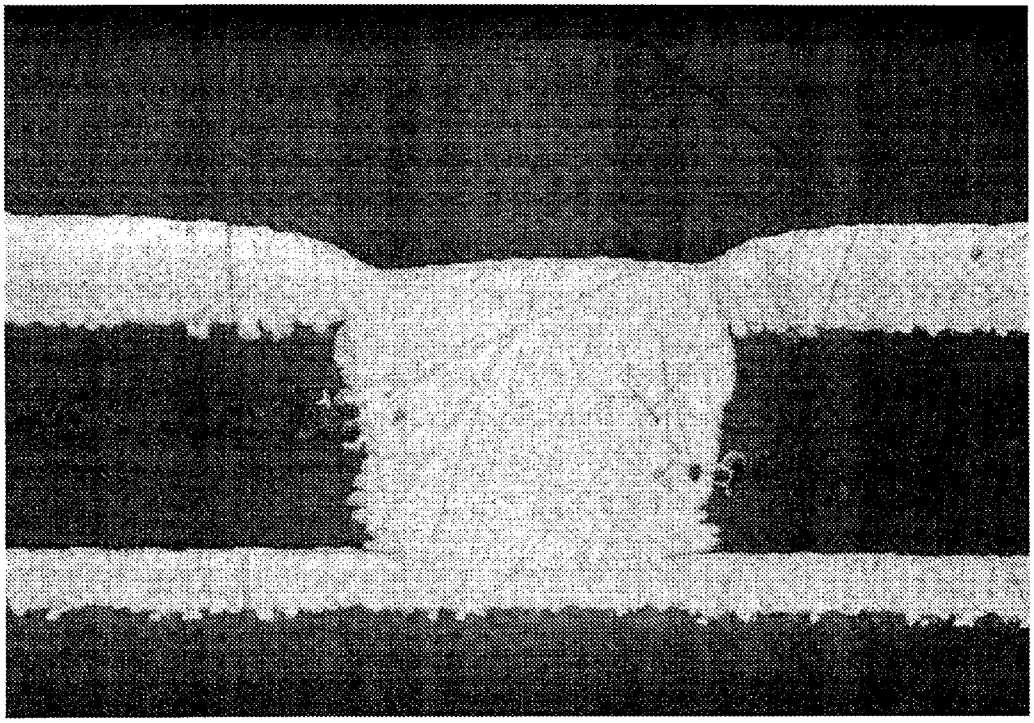
FIG. 4 is a drawing which shows the via filling ability when the plating solution of Working Example 3 is used; and it shows the state of a cross section of a via after the plating process.
Figure 5:
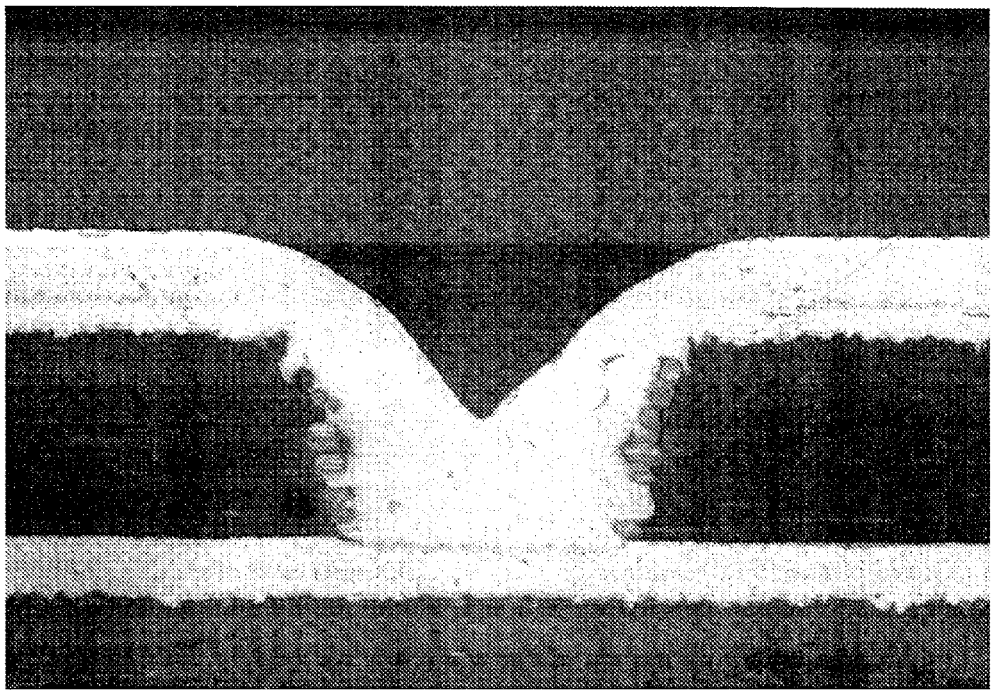
FIG. 5 is a drawing which shows the via filling ability when the plating solution of Comparison Example 2 is used; it shows the state of a cross section of a via after the plating process.

Various tests were performed using the additives shown in Table 1, and the results are shown in Table 1. FIG. 2 shows a microphotograph obtained when a via filling test was performed in Working Example 1. FIG. 3 shows a microphotograph obtained when a via filling test was performed in Working Example 2. FIG. 4 shows a microphotograph obtained when a via filling test was performed in Working Example 3, and FIG. 5 shows a microphotograph obtained when a via filling test was performed in Comparison Example 2.

TABLE 1

| Working/ Comparison Examples | Kind of additive | Galvanostatic measurement: Quantity of additive used (mg/L) | Galvanostatic measurement: Evaluation | Via filling test: Quantity of additive used (mg/L) | Via filling test: Evaluation | Overall evaluation |
|---|---|---|---|---|---|---|
| Working Example 1 | Hexahydro-1,3,5-trimethyl-1,3,5-triazine (2-1) | 1000 | A | 5 | Good | Good |
| Working Example 2 | Hexamethylene tetramine (2-2) | 1000 | A | 100 | Good | Good |
| Working Example 3 | Acetaldehyde ammonia trimer trihydrate (2-3) | 1000 | B | 100 | Good | Good |
| Comparison Example 1 | None (blank) | — | C | — | Bad | Bad |
| Comparison Example 2 | 1,4-Diazacyclohexane | 1000 | B | 15,000 | Bad | Bad |

Compound of Comparison Example 2

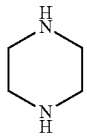

Compound of Comparison Example 3

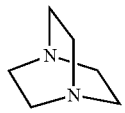

Compound of Comparison Example 4

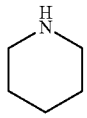

Compound of Comparison Example 5

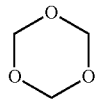

As is clear from Working Examples 1-3, high via filling performances were observed in the working examples in which the compounds shown in General formula (1) was used. In particular, the compound in Working Example 1 showed an increase in the via filling performance with a small quantity added. On the other hand, no improvements in via filling performance were seen in the example in which no additive was used (Comparison Example 1) and the examples in which compounds analogous to the compounds of general formula (1) were used (Comparison Examples 2-5).

What is claimed is:

1. An electrolytic copper plating solution comprising copper sulfate, copper cyanide or copper pyrophosphate; a compound shown by general formula (1):

(1)

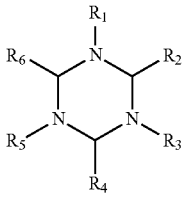

wherein $R_1$ to $R_6$ are, independent of each other, and are alkyl groups with carbon numbers of 1 to 4 which are optionally substituted with hydrogen atoms or functional groups; and compounds selected from the group consisting of:

(1) $M\text{-}SO_3\text{—}(CH_2)_a\text{—}S\text{—}(CH_2)_b\text{—}SO_3\text{-}M$;

(2) $M\text{-}SO_3\text{—}(CH_2)_a\text{—}O\text{—}CH_2\text{—}S\text{—}CH_2\text{—}O\text{—}(CH_2)_b\text{—}SO_3\text{-}M$;

(3) $M\text{-}SO_3\text{—}(CH_2)_a\text{—}S\text{—}S\text{—}(CH_2)_b\text{—}SO_3\text{-}M$;

(4) $M\text{-}SO_3\text{—}(CH_2)_a\text{—}O\text{—}CH_2\text{—}S\text{—}S\text{—}CH_2\text{—}O\text{—}(CH_2)_b\text{—}SO_3\text{-}M$;

(5) $M\text{-}SO_3\text{—}(CH_2)_a\text{—}S\text{—}C(=S)\text{—}S\text{—}(CH_2)_b\text{—}SO_3\text{-}M$; and (6) $M\text{-}SO_3\text{—}(CH_2)_a\text{—}O\text{—}CH_2\text{—}S\text{—}C(=S)\text{—}S\text{—}CH_2\text{—}O\text{—}(CH_2)_b\text{—}SO_3\text{-}M$, wherein a and b in compounds (1)-(6) are integers from 3 to 8, M is hydrogen or an alkali metal element.

2. An electrolytic copper plating solution comprising copper sulfate, copper cyanide or copper pyrophosphate; a compound shown by general formula (2):

(2)

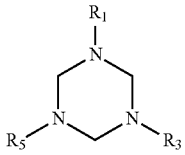

wherein $R_1$, $R_3$ and $R_5$ are, independent of each other, and are alkyl groups with carbon atom numbers of 1 to 4 which are optionally substituted with hydrogen atoms or functional groups;

and compounds selected from the group consisting of:

(1) $M\text{-}SO_3\text{—}(CH_2)_a\text{—}S\text{—}(CH_2)_b\text{—}SO_3\text{-}M$;

(2) $M\text{-}SO_3\text{—}(CH_2)_a\text{—}O\text{—}CH_2\text{—}S\text{—}CH_2\text{—}O\text{—}(CH_2)_b\text{—}SO_3\text{-}M$;

(3) $M\text{-}SO_3\text{—}(CH_2)_a\text{—}S\text{—}S\text{—}(CH_2)_b\text{—}SO_3\text{-}M$;

(4) $M\text{-}SO_3\text{—}(CH_2)_a\text{—}O\text{—}CH_2\text{—}S\text{—}S\text{—}CH_2\text{—}O\text{—}(CH_2)_b\text{—}SO_3\text{-}M$;

(5) $M\text{-}SO_3\text{—}(CH_2)_a\text{—}S\text{—}C(=S)\text{—}S\text{—}(CH_2)_b\text{—}SO_3\text{-}M$; and (6) $M\text{-}SO_3\text{—}(CH_2)_a\text{—}O\text{—}CH_2\text{—}S\text{—}C(=S)\text{—}S\text{—}CH_2\text{—}O\text{—}(CH_2)_b\text{—}SO_3\text{-}M$, wherein a and b in compounds (1)-(6) are integers from 3 to 8, M is hydrogen or an alkali metal element.

3. An electrolytic copper plating solution comprising copper sulfate, copper cyanide or copper pyrophosphate; a compound shown by general formula (3):

(3)

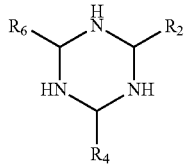

wherein $R_2$, $R_4$ and $R_6$ are, independent of each other, and are hydrogen atoms or alkyl groups with carbon numbers of 1 to 4; and compounds selected from the group consisting of:

(1) $M\text{-}SO_3\text{—}(CH_2)_a\text{—}S\text{—}(CH_2)_b\text{—}SO_3\text{-}M$;

(2) $M\text{-}SO_3\text{—}(CH_2)_a\text{—}O\text{—}CH_2\text{—}S\text{—}CH_2\text{—}O\text{—}(CH_2)_b\text{—}SO_3\text{-}M$;

(3) $M\text{-}SO_3\text{—}(CH_2)_a\text{—}S\text{—}S\text{—}(CH_2)_b\text{—}SO_3\text{-}M$;

(4) $M\text{-}SO_3\text{—}(CH_2)_a\text{—}O\text{—}CH_2\text{—}S\text{—}S\text{—}CH_2\text{—}O\text{—}(CH_2)_b\text{—}SO_3\text{-}M$;

(5) $M\text{-}SO_3\text{—}(CH_2)_a\text{—}S\text{—}C(=S)\text{—}S\text{—}(CH_2)_b\text{—}SO_3\text{-}M$; and (6) $M\text{-}SO_3\text{—}(CH_2)_a\text{—}O\text{—}CH_2\text{—}S\text{—}C(=S)\text{—}S\text{—}CH_2\text{—}O\text{—}(CH_2)_b\text{—}SO_3\text{-}M$, wherein a and b in compounds (1)-(6) are integers from 3 to 8, M is hydrogen or an alkali metal element.

4. A method of copper electroplating comprising:

a) providing a substrate;

b) providing a copper electroplating solution comprising copper sulfate, copper cyanide or copper pyrophosphate; a compound shown by general formula (1):

(1)

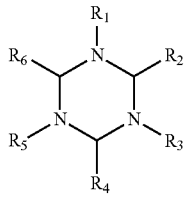

wherein $R_1$ to $R_6$ are, independent of each other, and are alkyl groups with carbon numbers of 1 to 4 which are optionally substituted with hydrogen atoms or functional groups; and compounds selected from the group consisting of:

(1) $M\text{-}SO_3\text{—}(CH_2)_a\text{—}S\text{—}(CH_2)_b\text{—}SO_3\text{-}M$;

(2) $M\text{-}SO_3\text{—}(CH_2)_a\text{—}O\text{—}CH_2\text{—}S\text{—}CH_2\text{—}O\text{—}(CH_2)_b\text{—}SO_3\text{-}M$;

(3) $M\text{-}SO_3\text{—}(CH_2)_a\text{—}S\text{—}S\text{—}(CH_2)_b\text{—}SO_3\text{-}M$;

(4) $M\text{-}SO_3\text{—}(CH_2)_a\text{—}O\text{—}CH_2\text{—}S\text{—}S\text{—}CH_2\text{—}O\text{—}(CH_2)_b\text{—}SO_3\text{-}M$;

(5) $M\text{-}SO_3\text{—}(CH_2)_a\text{—}S\text{—}C(=S)\text{—}S\text{—}(CH_2)_b\text{—}SO_3\text{-}M$; and (6) $M\text{-}SO_3\text{—}(CH_2)_a\text{—}O\text{—}CH_2\text{—}S\text{—}C(=S)\text{—}S\text{—}CH_2\text{—}O\text{—}(CH_2)_b\text{—}SO_3\text{-}M$, wherein a and b in compounds (1)-(6) are integers from 3 to 8, M is hydrogen or an alkali metal element;

c) immersing the substrate in the copper electroplating solution; and d) electroplating copper on the substrate.

5. A method of copper electroplating comprising:

a) providing a substrate;

b) providing a copper electroplating solution comprising copper sulfate, copper cyanide or copper pyrophosphate; a compound shown by general formula (2):

(2)

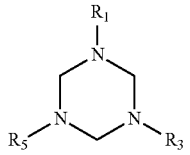

wherein $R_1$, $R_3$ and $R_5$ are, independent of each other, and are alkyl groups with carbon atom numbers of 1 to 4 which are optionally substituted with hydrogen atoms or functional groups; and compounds selected from the group consisting of:

(1) $M\text{-}SO_3\text{—}(CH_2)_a\text{—}S\text{—}(CH_2)_b\text{—}SO_3\text{-}M$;

(2) $M\text{-}SO_3\text{—}(CH_2)_a\text{—}O\text{—}CH_2\text{—}S\text{—}CH_2\text{—}O\text{—}(CH_2)_b\text{—}SO_3\text{-}M$;

(3) $M\text{-}SO_3\text{—}(CH_2)_a\text{—}S\text{—}S\text{—}(CH_2)_b\text{—}SO_3\text{-}M$;

(4) $M\text{-}SO_3\text{—}(CH_2)_a\text{—}O\text{—}CH_2\text{—}S\text{—}S\text{—}CH_2\text{—}O\text{—}(CH_2)_b\text{—}SO_3\text{-}M$;

(5) $M\text{-}SO_3\text{—}(CH_2)_a\text{—}S\text{—}C(=S)\text{—}S\text{—}(CH_2)_b\text{—}SO_3\text{-}M$; and (6) $M\text{-}SO_3\text{—}(CH_2)_a\text{—}O\text{—}CH_2\text{—}S\text{—}C(=S)\text{—}S\text{—}CH_2\text{—}O\text{—}(CH_2)_b\text{—}SO_3\text{-}M$, wherein a and b in compounds (1)-(6) are integers from 3 to 8, M is hydrogen or an alkali metal element;

c) immersing the substrate in the copper electroplating solution; and d) electroplating copper on the substrate.

6. A method of copper electroplating comprising:

a) providing a substrate;

b) providing a copper electroplating solution copper sulfate, copper cyanide or copper pyrophosphate; a compound shown by general formula (3):

(3)

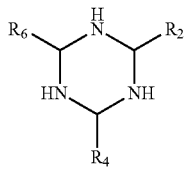

wherein $R_2$, $R_4$ and $R_6$ are, independent of each other, and are hydrogen atoms or alkyl groups with carbon numbers of 1 to 4; and compounds selected from the group consisting of:

(1) $M\text{-}SO_3\text{—}(CH_2)_a\text{—}S\text{—}(CH_2)_b\text{—}SO_3\text{-}M$;

(2) $M\text{-}SO_3\text{—}(CH_2)_a\text{—}O\text{—}CH_2\text{—}S\text{—}CH_2\text{—}O\text{—}(CH_2)_b\text{—}SO_3\text{-}M$;

(3) $M\text{-}SO_3—(CH_2)_a—S—S—(CH_2)_b—SO_3\text{-}M$;

(4) $M\text{-}SO_3—(CH_2)_a—O—CH_2—S—S—CH_2—O—(CH_2)_b—SO_3\text{-}M$;

(5) $M\text{-}SO_3—(CH_2)_a—S—C(=S)—S—(CH_2)_b—SO_3\text{-}M$; and (6) $M\text{-}SO_3—(CH_2)_a—O—CH_2—S—C(=S)—S—CH_2—O—(CH_2)_b—SO_3\text{-}M$, wherein a and b in compounds (1)-(6) are integers from 3 to 8, M is hydrogen or an alkali metal element;

c) immersing the substrate in the copper electroplating solution; and d) electroplating copper on the substrate.

* * * * *